US008839525B2

(12) United States Patent
Pulkrabek et al.

(10) Patent No.: US 8,839,525 B2
(45) Date of Patent: Sep. 23, 2014

(54) PIN ARRAY ADJUSTMENT SYSTEM FOR MULTI-AXIS BOW SIGHT

(75) Inventors: Larry Pulkrabek, Osceola, IA (US); Jay Engstrom, Port Wing, WI (US); Aaron Pellett, Alborn, MN (US); Lee Trueblood, Duluth, MN (US)

(73) Assignee: Field Logic, Inc., Superior, WI (US)

( * ) Notice: Subject to any disclaimer, the term of this patent is extended or adjusted under 35 U.S.C. 154(b) by 328 days.

(21) Appl. No.: 13/345,478

(22) Filed: Jan. 6, 2012

(65) Prior Publication Data

US 2013/0174431 A1 Jul. 11, 2013

(51) Int. Cl.
*F41G 1/467* (2006.01)

(52) U.S. Cl.
USPC ..... 33/265; 124/87

(58) Field of Classification Search
USPC ..... 33/265; 124/87
See application file for complete search history.

(56) References Cited

U.S. PATENT DOCUMENTS

| | | | | |
|---|---|---|---|---|
| 3,097,432 | A | | 7/1963 | Shaw |
| 3,470,616 | A | | 10/1969 | Thompson |
| 3,693,262 | A | * | 9/1972 | Wood ..... 33/265 |
| 4,400,887 | A | | 8/1983 | Mason |
| 4,473,959 | A | | 10/1984 | Saltzman |
| 4,625,421 | A | | 12/1986 | Strauss |
| 4,764,011 | A | | 8/1988 | Goldstein |
| 4,928,394 | A | | 5/1990 | Sherman |
| 5,080,084 | A | | 1/1992 | Kendall et al. |
| 5,121,547 | A | | 6/1992 | Littlejohn |
| 5,152,068 | A | * | 10/1992 | Meister et al. ..... 33/265 |
| 5,157,839 | A | | 10/1992 | Beutler |
| 5,168,631 | A | | 12/1992 | Sherman |
| 5,201,124 | A | | 4/1993 | Sherman |
| 5,231,765 | A | | 8/1993 | Sherman |
| 5,303,479 | A | | 4/1994 | Rudovsky |
| 5,308,986 | A | | 5/1994 | Walker |
| 5,338,037 | A | | 8/1994 | Toyohara |
| 5,384,966 | A | | 1/1995 | Gibbs |
| 5,420,959 | A | | 5/1995 | Walker et al. |
| 5,442,861 | A | | 8/1995 | Lorocco |
| 5,560,113 | A | | 10/1996 | Simo et al. |
| 5,606,638 | A | | 2/1997 | Tymianski et al. |
| 5,638,604 | A | | 6/1997 | Lorocco |
| 5,649,526 | A | | 7/1997 | Ellig |
| 5,685,081 | A | | 11/1997 | Winegar |
| 5,694,713 | A | * | 12/1997 | Paldino ..... 33/DIG. 21 |
| 5,764,410 | A | * | 6/1998 | Jibiki ..... 359/422 |
| 5,850,700 | A | | 12/1998 | Capson et al. |
| 5,862,603 | A | | 1/1999 | Ellig |
| RE36,266 | E | | 8/1999 | Gibbs |
| 5,956,854 | A | | 9/1999 | Lorocco |

(Continued)

*Primary Examiner* — Yaritza Guadalupe-McCall
(74) *Attorney, Agent, or Firm* — Stoel Rives LLP

(57) ABSTRACT

A sighting device for a bow that includes a support assembly adapted to attach to the bow. A bezel assembly is attached to the support assembly. The bezel assembly includes a micro-adjust with a lead screw located adjacent to a bezel opening. A plurality of pin carriers each include a slider selectively moveable between an engaged position coupled to the lead screw and a disengaged position. As a result, each pin carrier is adapted to be selectively and independently displaced or not displaced by rotation of the micro-adjust. A plurality of sight pins are coupled to the pin carriers. Each sight pin includes a sight point at a distal end located in the bezel opening and a proximal end coupled to one of the pin carriers. The sight points are adapted to align the bow with a target viewed through the bezel opening.

21 Claims, 15 Drawing Sheets

(56) References Cited

U.S. PATENT DOCUMENTS

| | | | | |
|---|---|---|---|---|
| 6,000,141 | A | 12/1999 | Afshari | |
| 6,016,608 | A | 1/2000 | Lorocco | |
| 6,082,012 | A * | 7/2000 | McLeod | 33/265 |
| 6,122,833 | A | 9/2000 | Lorocco | |
| 6,191,574 | B1 * | 2/2001 | Dilger | 33/265 |
| 6,216,352 | B1 | 4/2001 | Lorocco | |
| 6,311,405 | B1 | 11/2001 | Slates | |
| 6,360,472 | B1 | 3/2002 | Lorocco | |
| 6,385,855 | B1 | 5/2002 | Tymianski | |
| 6,421,946 | B1 | 7/2002 | LoRocco | |
| 6,477,778 | B1 | 11/2002 | Lorocco | |
| 6,477,780 | B2 | 11/2002 | Aldred | |
| 6,557,291 | B2 | 5/2003 | Hoadley | |
| 6,560,884 | B1 | 5/2003 | Afshari | |
| 6,564,462 | B1 | 5/2003 | Henry | |
| 6,571,482 | B1 | 6/2003 | Tymianski | |
| 6,581,317 | B1 | 6/2003 | Slates | |
| 6,634,110 | B2 * | 10/2003 | Johnson | 33/265 |
| 6,634,111 | B2 | 10/2003 | LoRocco | |
| 6,725,854 | B1 | 4/2004 | Afshari | |
| 6,796,037 | B1 | 9/2004 | Geffers et al. | |
| 6,802,129 | B1 | 10/2004 | Wirth | |
| 6,817,105 | B2 | 11/2004 | LoRocco | |
| 6,925,721 | B2 * | 8/2005 | Dietz | 33/265 |
| 6,938,349 | B2 | 9/2005 | Afshari | |
| 6,964,105 | B2 * | 11/2005 | McLeod | 33/265 |
| 6,981,329 | B1 | 1/2006 | Strathman | |
| 7,036,234 | B2 | 5/2006 | Rager | |
| 7,200,943 | B2 | 4/2007 | Afshari | |
| 7,278,216 | B2 * | 10/2007 | Grace | 33/265 |
| 7,290,345 | B2 | 11/2007 | Ellig | |
| 7,308,891 | B2 * | 12/2007 | Graf | 124/87 |
| 7,331,112 | B2 | 2/2008 | Gibbs | |
| 7,343,686 | B2 * | 3/2008 | Rager | 33/265 |
| 7,360,313 | B1 * | 4/2008 | Hamm et al. | 33/265 |
| 7,461,460 | B2 | 12/2008 | Priebe | |
| 7,464,477 | B2 * | 12/2008 | Afshari | 33/265 |
| 7,503,122 | B2 | 3/2009 | Afshari | |
| 7,503,321 | B2 | 3/2009 | Afshari | |
| 7,562,486 | B2 | 7/2009 | LoRocco | |
| 7,574,810 | B1 | 8/2009 | LoRocco | |
| 7,574,811 | B2 * | 8/2009 | Kurtzhals et al. | 33/265 |
| 7,814,668 | B1 | 10/2010 | Pulkrabek et al. | |
| 7,832,109 | B2 | 11/2010 | Gibbs et al. | |
| 7,900,365 | B1 * | 3/2011 | Johnson | 33/265 |
| 7,921,570 | B1 * | 4/2011 | Pulkrabek et al. | 33/265 |
| 7,958,643 | B1 | 6/2011 | Wu | |
| 8,006,395 | B2 * | 8/2011 | Kingsbury | 33/265 |
| 8,079,153 | B2 | 12/2011 | Pulkrabek et al. | |
| 8,186,068 | B2 | 5/2012 | Pulkrabek et al. | |
| 2003/0110647 | A1 | 6/2003 | Henry | |
| 2005/0132588 | A1 * | 6/2005 | McLeod | 33/265 |
| 2005/0235503 | A1 | 10/2005 | Afshari | |
| 2006/0254065 | A1 * | 11/2006 | Grace | 33/265 |
| 2007/0028467 | A1 | 2/2007 | Bradley et al. | |
| 2009/0000134 | A1 * | 1/2009 | Kurtzhals et al. | 33/265 |
| 2009/0199418 | A1 | 8/2009 | LoRocco | |
| 2009/0235540 | A1 * | 9/2009 | Rager | 33/265 |
| 2011/0277329 | A1 * | 11/2011 | Summers et al. | 33/265 |
| 2013/0118019 | A1 * | 5/2013 | Kingsbury et al. | 33/265 |
| 2013/0174430 | A1 * | 7/2013 | Pulkrabek et al. | 33/228 |
| 2013/0174431 | A1 * | 7/2013 | Pulkrabek et al. | 33/228 |

* cited by examiner

PIN ARRAY ADJUSTMENT SYSTEM FOR MULTI-AXIS BOW SIGHT

FIELD OF THE INVENTION

The present disclosure is directed to a multi-axis bow sight that permits individual pins in a pin array to be selectively and independently repositioned using a single micro-adjust. The present disclosure is also directed to a support assembly for the multi-axis bow sight that decouples bow cant from operation of the elevation and windage adjustments.

BACKGROUND OF THE INVENTION

A common type of archery bow sight employs an array of vertically-spaced apart sight pins, each corresponding to a different range (distance to a target). These pins are installed in a frame or bezel, which is mounted to the riser of the bow. The spacing between the individual sight pins and the position of the sight pins within the bezel is typically adjustable to compensate for the particular shooter, the bow, the type of arrows used, and the like.

One type of adjustment system is a simple set screw that is loosened to permit the sight pin to slide in a slot formed in the bezel, such as disclosed in U.S. Pat. No. 7,832,109 (Gibbs). Once the desired location is found, the set screw is tightened. Alternatively, the sight pins are adjusted using a threaded lead screw. A separate lead screw is typically required for each sight pin to permit independent adjustable within the bezel, resulting in increased weight, cost, and complexity.

In addition to adjustments for the location of the sight pins within the bezel, many bow sights include elevation and windage adjustments that reposition the bezel with respect to the bow. FIG. 1 illustrates a bow sight 20 with elevation assembly 22 that permits rapid movement along a fine adjustment screw, such as disclosed in U.S. Pat. No. RE 36,266 (Gibbs) and U.S. Pat. No. 7,331,112 (Gibbs). The Gibbs patents disclose a slidable three-point stabilizing mounting for the elevation assembly that can be adjusted without need of manually holding a coupling/uncoupling device in an uncoupled position during the adjustment.

The elevation assembly 22 permits the shooter to raise and lower the bezel 24 relative to the bow sight 20 along vertical axis 26 to compensate for distance. Windage assembly 32 permits the shooter to move the bezel 24 along horizontal axis 34 to compensate for wind conditions. The operation of the elevation and windage assemblies 22 32, however, is dependent on the bow 28 being held vertical, as illustrated in FIG. 2.

Human physiology is such that when the arm muscles are in a relaxed state the shooters has a natural tendency to hold a bow at an angled or canted position. Alternatively, the shooter may have a preferred angle or cant for holding the bow. As used herein, "bow cant" refers to a shooter's natural and/or preferred angle for holding a bow relative to vertical. Right-handed shooters cant or angle the bow 28 to the left and left-handed shooters cant the bow 28 to the right. The degree of cant varies between shooters, but is generally in the range of about 20 degrees.

FIG. 3 illustrates the bow 28 held at a bow cant 30 relative to vertical 26 by a right-handed shooter. As a result of the bow cant 30, the elevation assembly moves the bezel 24 to one side or the other as it moves along non-vertical axis 36, reducing shooting accuracy. Similarly, the windage assembly moves the bezel 24 up or down as it moves along non-horizontal axis 38. The individual pins 25 also move on the non-vertical axis 36 when adjusted.

The Gibbs '112 patent discloses a bow cant adjustment that permits the bezel 24 to be rotated level relative to the shooter as illustrated in FIG. 4. The cant adjustment, however, is located adjacent the bezel 24 so the elevation assembly 22, the windage assembly 32, and the pin adjustment axis are still canted at bow cant angle 30 relative to vertical 26. Consequently, adjustment of the elevation assembly 22, windage assembly 32, or pin 25 causes the pins 25 to travel along the axes 36, 38, as illustrated in FIG. 3.

BRIEF SUMMARY OF THE INVENTION

The present disclosure is directed to a multi-axis bow sight that permits individual pins in a pin array to be selectively and independently adjusted using a single micro-adjust. Each sight pin can be independently engaged or disengaged from the micro-adjust lead screw. The spring loaded pin carriers automatically disengage from the micro-adjust lead screw to prevent inadvertent damage to the threads.

The present disclosure is also directed to a support assembly for the multi-axis bow sight that decouples bow cant from operation of the elevation and windage adjustments. An eye alignment assembly is preferably included with the bezel.

The present disclosure is directed to a sighting device for a bow that includes a support assembly adapted to attach to the bow. A bezel assembly is attached to the support assembly. The bezel assembly includes a micro-adjust with a lead screw located adjacent to a bezel opening. A plurality of pin carriers each include a slider selectively moveable between an engaged position coupled to the lead screw and a disengaged position. As a result, each pin carrier is adapted to be selectively and independently displaced or not displaced by rotation of the lead screw. A plurality of sight pins are coupled to the pin carriers. Each sight pin includes a sight point at a distal end located in the bezel opening and a proximal end coupled to one of the pin carriers. The sight points are generally oriented along an axis that is parallel to the lead screw. The sight points are adapted to align the bow with a target viewed through the bezel opening.

The pin carriers preferably include a spring that biases the slider into the engaged position. Each pin carriers includes a pin adjustment screw adapted to retain the slider to the disengaged position. At least one stabilizing pin parallel to the lead screw preferably extends through each of the pin carriers. The pin adjustment screws on the pin carriers bias the slider against the stabilizing pin in a locked position that retains the pin carrier in a particular location relative to the bezel opening. The slider preferably includes an indicator tab visible in the bezel opening providing an indication of the locked position.

In one embodiment, the support assembly includes a proximal portion that is adapted to attach to the bow. A distal portion is rotatably attached to the proximal portion and adapted to rotate around a longitudinal axis of the proximal portion so the sight points are oriented generally along a vertical axis while the bow is held at a bow cant greater than zero. The support assembly preferably includes a micro-adjust adapted to control the rotational position around the longitudinal axis of the distal portion relative to the proximal portion. An elevation assembly optionally attaches the distal portion to the bezel assembly. The elevation assembly is adapted to move the bezel assembly along a substantially vertical axis while the bow is held at a bow cant greater than zero. As a result, the micro-adjust decouples the shooter's bow cant from operation of the elevation assembly. An adjustable windage assembly is preferably interposed between the distal portion and the bezel assembly.

In one embodiment, an eye alignment assembly is mounted to the bezel assembly. The eye alignment assembly includes a sight point of an optical fiber positioned a distance behind an alignment indicia on a lens. An adjustment system is provided to reorient the lens relative to the bezel assembly. The eye alignment assembly provides an indication of orientation of the shooter relative to the bow in at least two degrees of freedom. The alignment indicia on the lens is aligned with the sight point on the optical fiber only when the shooter is in a predetermined relationship with respect to the bow.

The present disclosure is also directed to a method of adjusting sight pins on a bow sight for a bow. The method includes selectively moving a slider on each of a plurality of pin carriers to either an engaged position coupled to a lead screw of a micro-adjust located on a bezel assembly, or a disengaged position not engaged with the lead screw, such that each pin carrier is selectively and independently displaced or not displaced by rotation of the lead screw. The micro-adjust is rotated to displace only the pin carriers with its sliders in the engaged position, while simultaneously not displacing the pin carriers with the sliders in the disengaged position.

At least one sight pin is attached to each pin carrier so that sight points on the sight pins are located in the bezel opening. The sight points are oriented generally along an axis that is parallel to the lead screw.

In one embodiment, the shooter holds the bow at the shooter's bow cant. A micro-adjust is operated to rotate a distal portion of the segmented support assembly around the Y-axis relative to the proximal portion until the bezel assembly is substantially horizontal. Once the bezel is horizontal, an elevation micro-adjust on an elevation assembly attached to the distal portion is operated to move the bezel assembly along a substantially vertical axis while the bow is held at a bow cant greater than zero. The method also includes operating a windage assembly interposed between the distal portion and the bezel assembly to move the bezel assembly substantially horizontally.

In another embodiment, the bow is held at a preferred orientation. The shooter views an eye alignment assembly mounted on the bezel. The eye alignment assembly includes a sight point of an optical fiber and alignment indicia on a lens. The user adjusts the orientation of the eye alignment assembly relative to the bezel assembly so the sight point is aligned with the alignment indicia on a lens. Once the eye alignment assembly is adjusted for the shooters preferred bow orientation, holding the bow so the sight point on the eye alignment assembly is aligned with the alignment indicia on a lens results in the bow being at the preferred orientation.

DETAILED DESCRIPTION OF THE INVENTION

Figure 1:
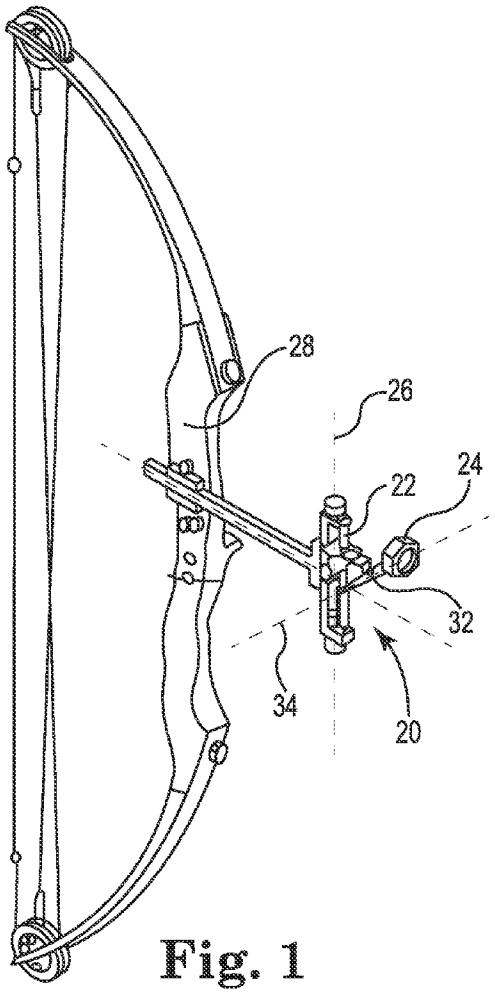
Fig. 1 PRIOR ART
FIG. 1 is a perspective view of a compound bow with a prior art elevation assembly and windage assembly.
Figure 4:
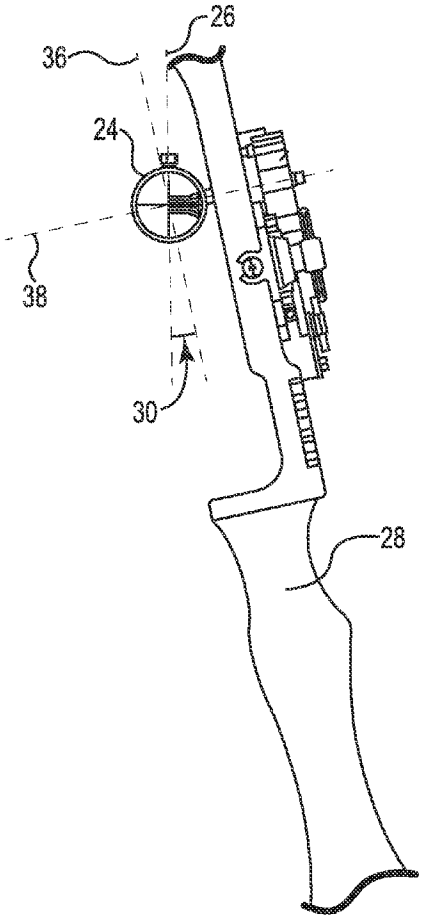
Fig. 4 PRIOR ART
FIG. 4 is a rear view of the bow of FIG. 3 with the bezel rotated to compensate for the bow cant.
Figure 3:
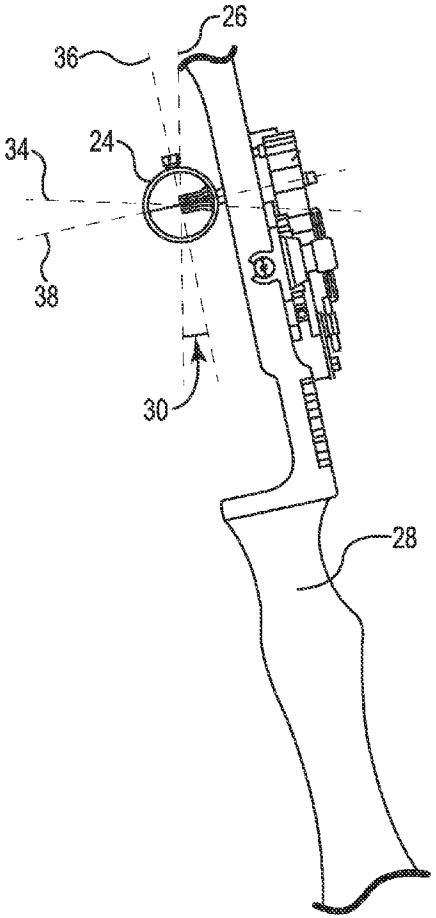
Fig. 3 PRIOR ART
FIG. 3 is a rear view of the bow of FIG. 1 held at a shooter's bow cant by a right-handed shooter.
Figure 5:
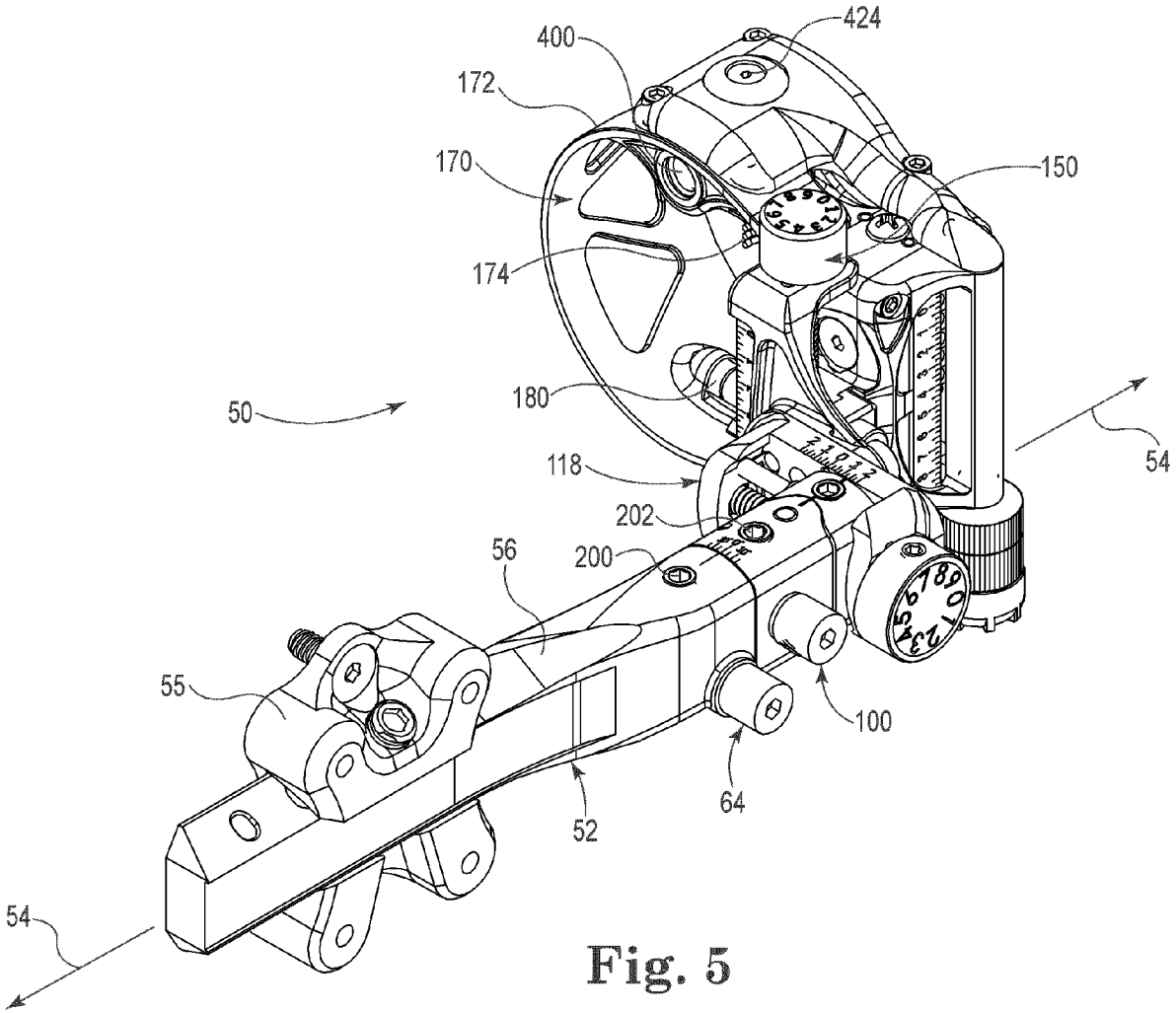
FIG. 5 is a perspective view of a multi-axis bow sight in accordance with an embodiment of the present disclosure.

FIG. 5 illustrates a multi-axis bow sight 50 in accordance with an embodiment of the present disclosure. The bow sight 50 includes multi-segmented support assembly 52 that attaches to a bow in front of the riser, generally as illustrated in FIG. 1. Proximal portion 56 of the support assembly 52 is attached to a bow using a variety of sliding mounting structures 55 that permit adjustment along the Y-axis 54, such as disclosed in U.S. Pat. No. 7,832,109 (Gibbs), which is hereby incorporated by reference. As used herein, references to "X-axis," "Y-axis," or "Z-axis" relate to an orthogonal coordinate system that is used to describe the relative position of features on the bow sight 50, and not necessarily related to absolute vertical or horizontal unless otherwise stated.

Figure 6:
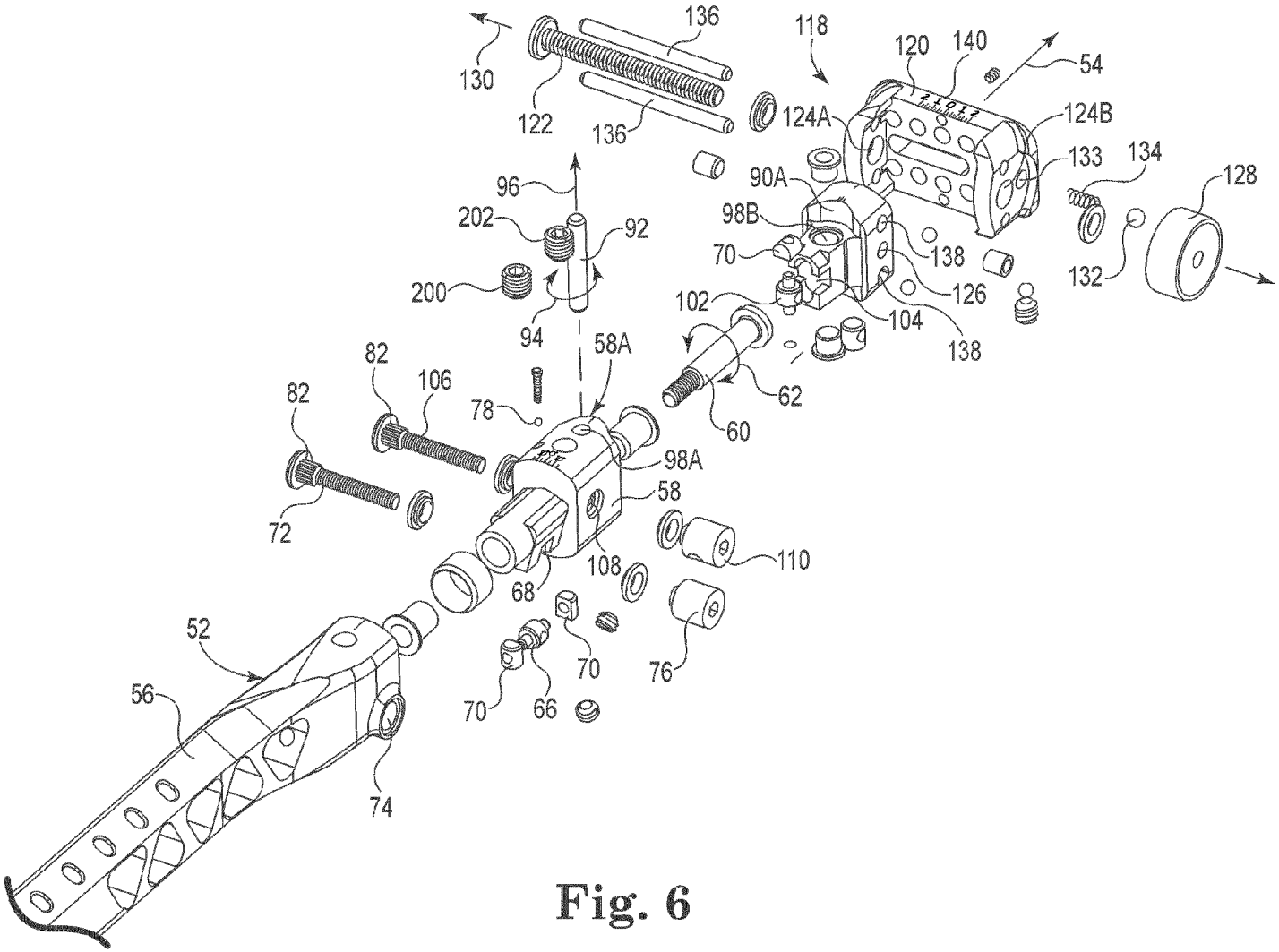
FIG. 6 is an exploded view of a mounting structure of the bow sight of FIG. 5.

FIG. 6 is an exploded view of the support assembly 52 of FIG. 5. Proximal portion 56 attaches to the bow as noted above. Intermediate portion 58 is rotatably attached to the proximal portion 56 by pivot pin 60. Pivot pin 60 permits the intermediate portion 58 to rotate in direction 62 around the longitudinal or Y-axis 54 of the proximal portion 56.

Figure 7:
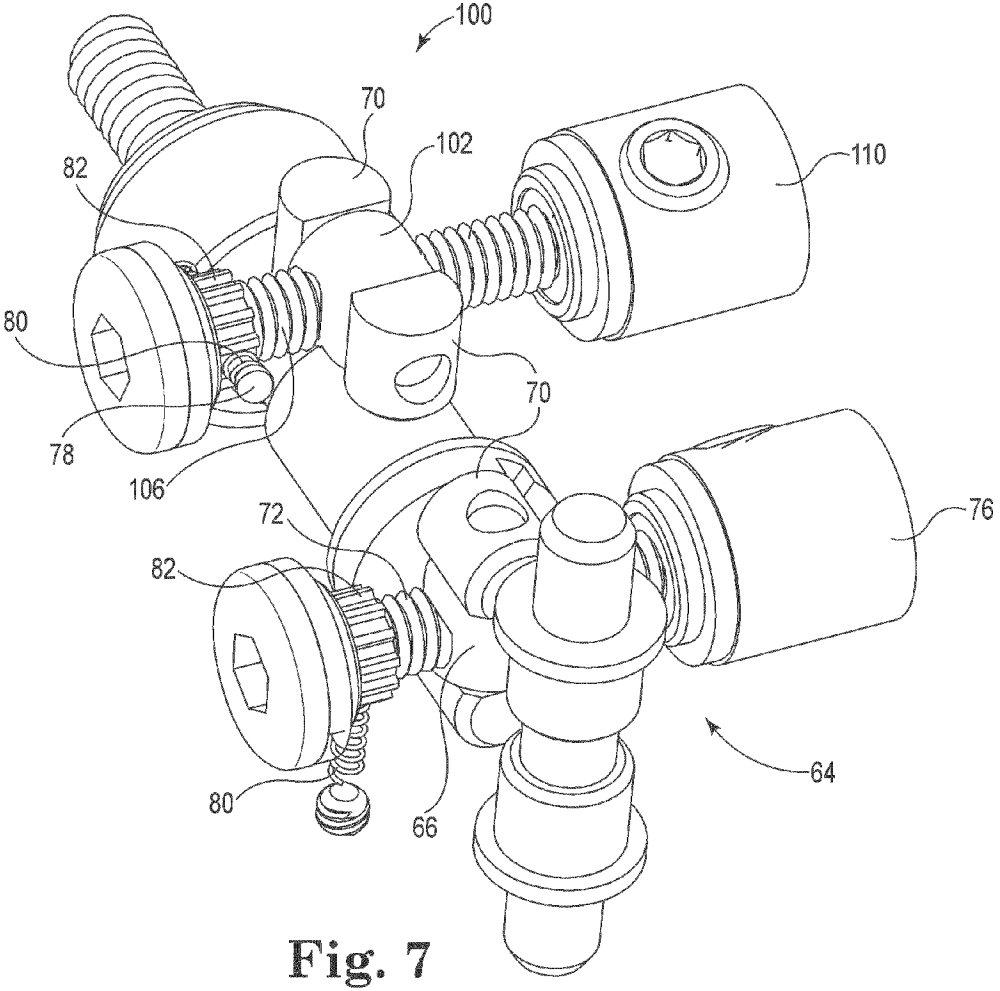
FIG. 7 is a perspective view of a micro-adjust for a bow sight in accordance with an embodiment of the present disclosure.

Rotational position of the intermediate portion 58 relative to the proximal portion 56 is controlled by micro-adjust assembly 64 illustrated in FIGS. 6 and 7. Threaded traveler 66 is rotatably attached to intermediate portion 58 in cavity 68 by polymeric washers 70. In the illustrated embodiment the washers 70 are made from Delrin®. Lead screw 72 extends through holes 74 in the proximal portion 56 and engages with the threads in the traveler 66. Since the cavity 68 is located offset from the axis of the pivot pin 60, rotation of knob 76 displaces the traveler 66 left or right, resulting in rotational movement 62 of the intermediate portion 58 relative to the proximal portion 56 (see e.g., FIG. 11B). Ball bearing 78 is preferably biased by spring 80 to engage teeth 82 on the lead screw 72 to provide feedback during rotation of the knob 76. The teeth 82 act also as detents to reduce the risk of inadvertent rotation of the lead screw 72.

As used herein, "micro-adjust" refers to an assembly including a threaded traveler engaged with threads of a precision lead screw to precisely control the relative position of two components. For example, the threads can have a pitch of about 0.5 millimeters (50.8 threads per inch), with a sensitivity of less than about 2 micrometers. A setscrew preferably locks the micro-adjust in the desired position.

Turning back to FIG. 6, distal portion 90 is optionally pivotally attached to the intermediate portion 58 by pivot pin 92 extending through holes 98A, 98B. Pivot pin 92 permits the distal portion 90 to rotate in direction 94 around Z-axis 96 in a plane perpendicular to the Z-axis 96. Complementary curved surfaces 58A, 90A at the interface of the intermediate portion 58 to the distal portion 90 facilitate rotation 94. Rotational position of the distal portion 58 is controlled by micro-adjust assembly 100.

Threaded traveler 102 is rotatably attached to distal portion 90 in cavity 104 by polymeric washers 70. Lead screw 106 extends through holes 108 in the intermediate portion 58 and engages with the threads in the traveler 102. Since the cavity 104 is located offset from the Z-axis 96, rotation of knob 110 displaces the traveler 102 left or right, resulting in rotational movement 94 of the distal portion 90 relative to the intermediate portion 58 (see e.g., FIGS. 12B and 12C). Ball bearing 78 is biased toward teeth 82 on the lead screw 106 to provide feedback during rotation of the knob 110 and to reduce the risk of inadvertent rotation of the lead screw 106.

Figure 8:
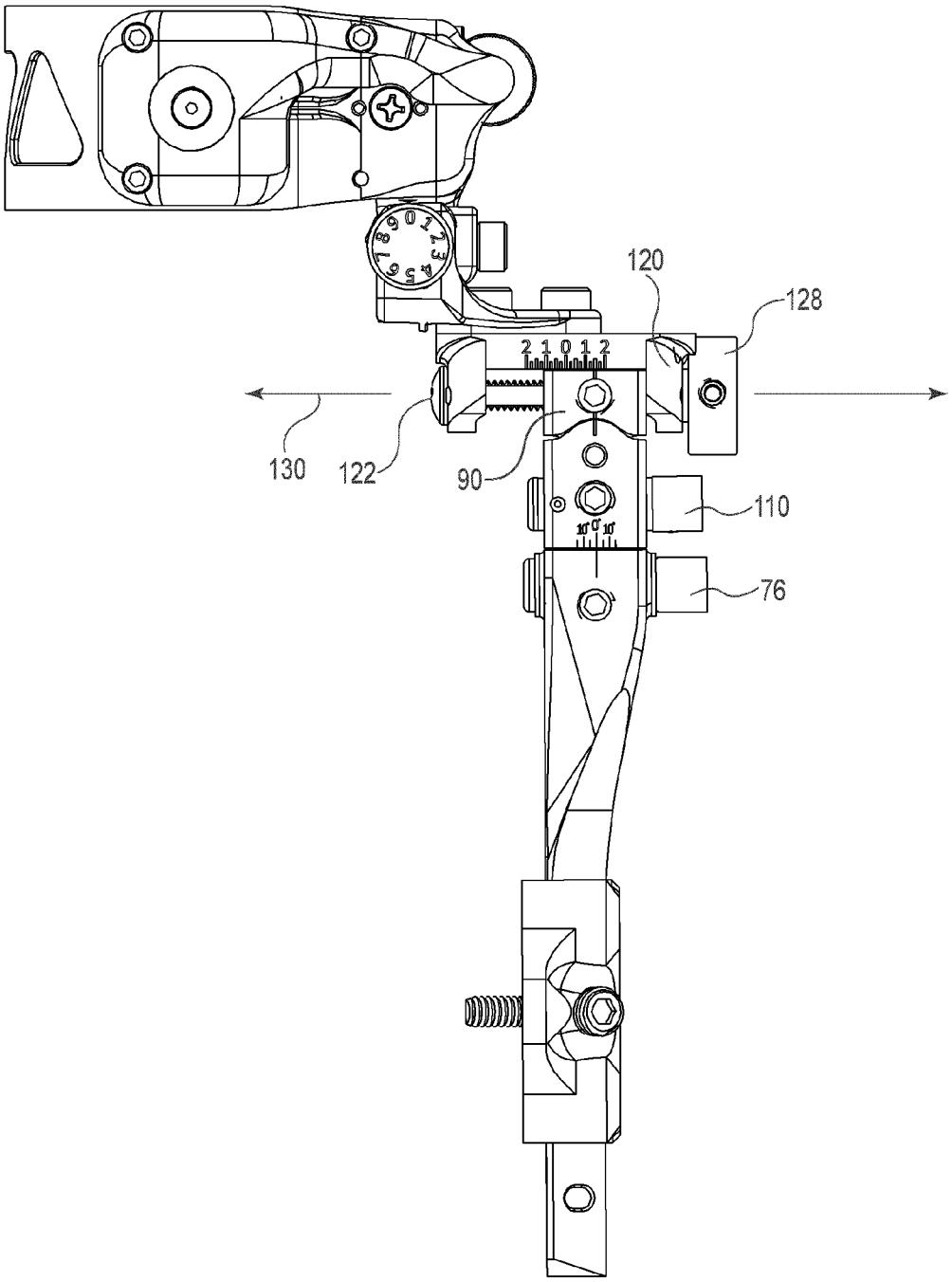
FIG. 8 is a top view of the bow sight of FIG. 5.

Windage assembly 118 illustrated in FIGS. 6 and 8 compensates for wind conditions. Windage block 120 is attached to distal portion 90 by lead screw 122. The lead screw 122 passes through opening 124A in the windage block 120, engages with threaded hole 126 in the distal portion 90, and passed through opposite opening 124B to engaged with knob 128. Rotation of the knob 128 causes the windage block 120 to be displaced left and right relative to the distal portion 90 along X-axis 130. Windage block 120 includes indicia 140 to provide an indication of position relative to the intermediate portion 90.

Ball bearing 132 located in recess 133 in windage block 120 is preferably biased by spring 134 against detents on knob 128. Pins 136 extend through holes 138 in the distal portion 90 to stabilize movement of the windage block 120 along the X-axis 130.

Figure 9:
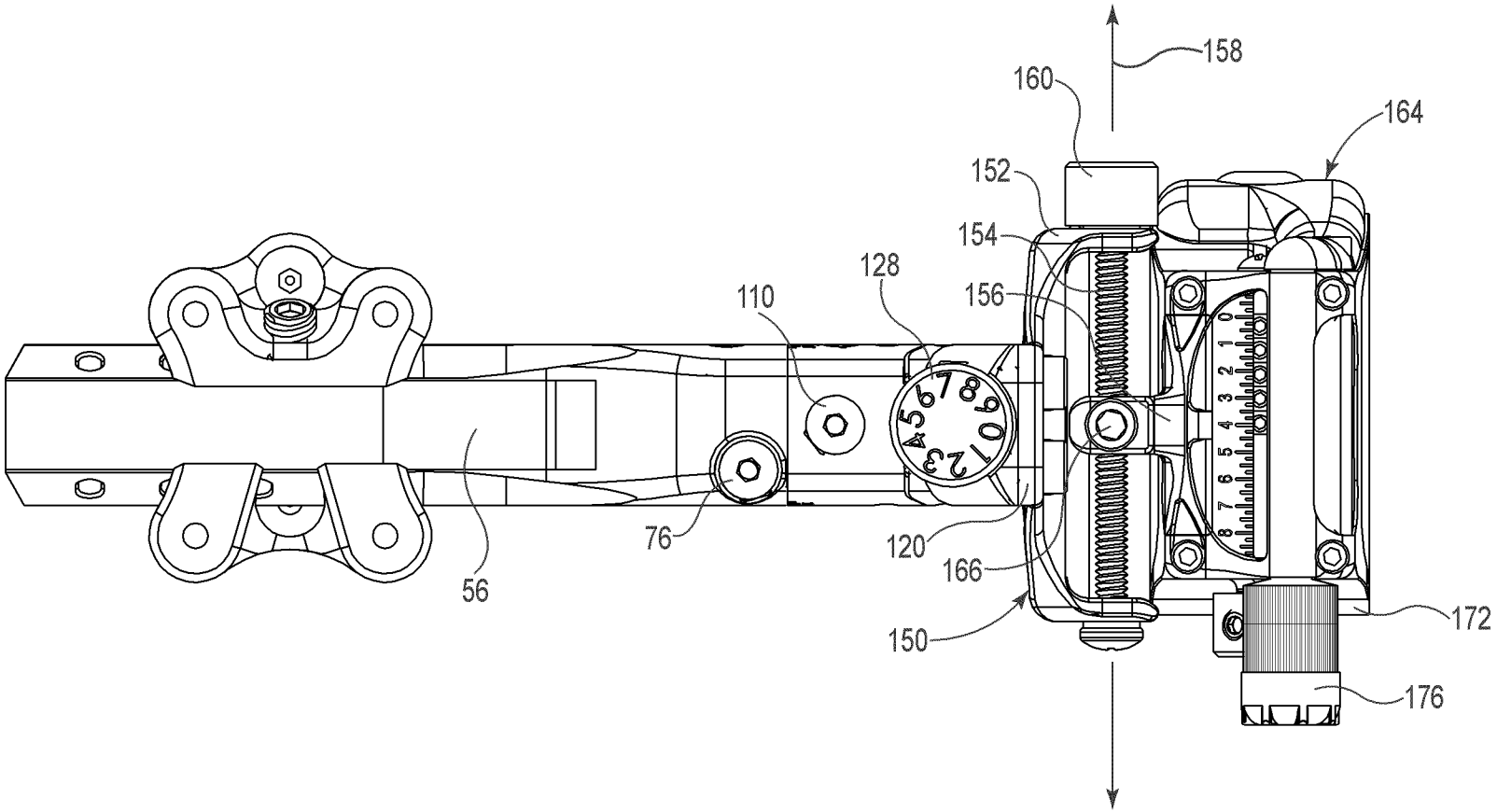
FIG. 9 is an alternate perspective view of the bow sight of FIG. 5.
Figure 10:
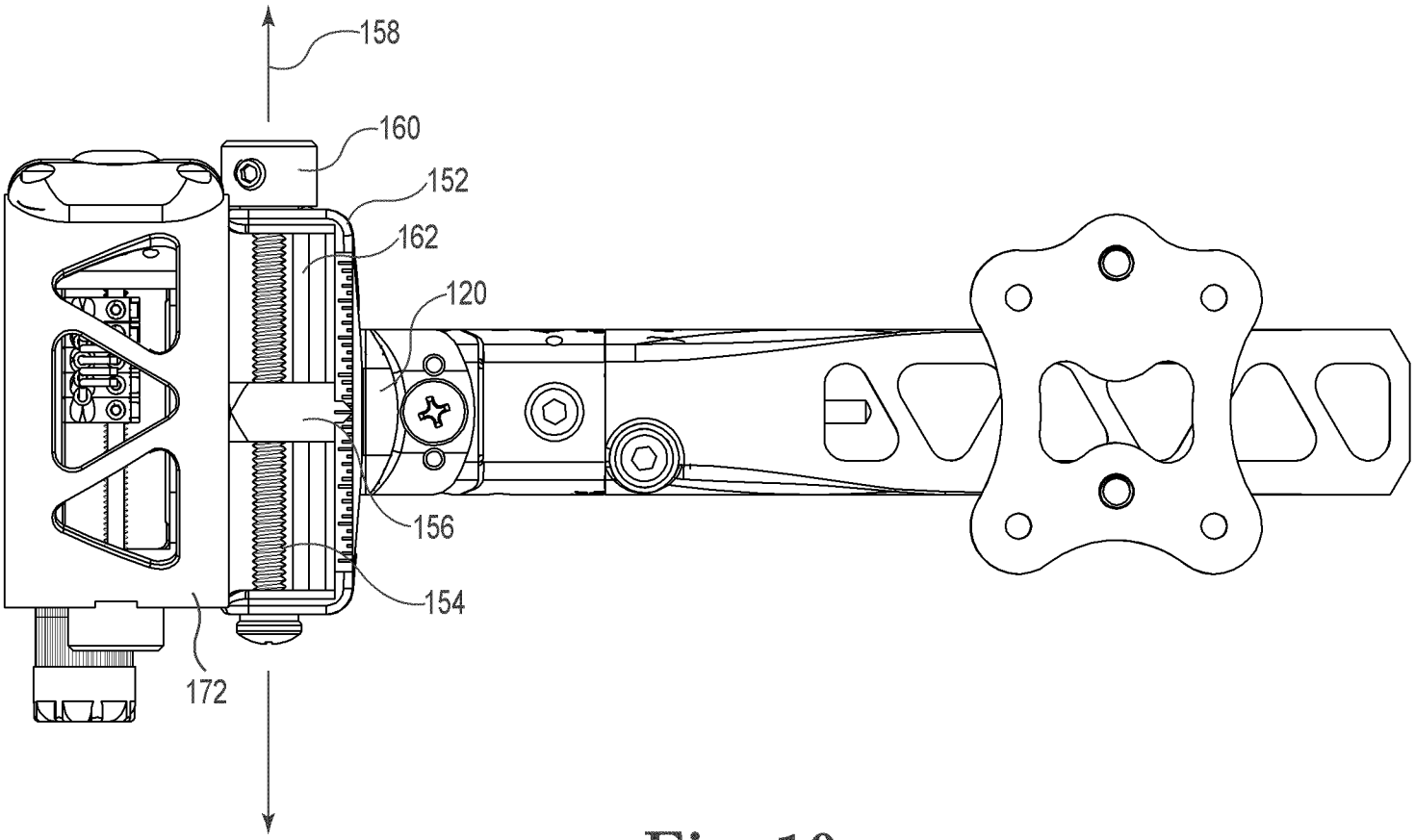
FIG. 10 is a side view of the bow sight of FIG. 5.

As best illustrated in FIGS. 9 and 10, elevation assembly 150 is attached to windage block 120. Elevation block 152 includes a finely threaded lead screw 154 adapted to move bezel traveler 156 along axis 158 parallel to the Z-axis 96. Pin 162 stabilizes the bezel traveler 156 as it moves along the lead screw 154. Knobs 160 are located at the top of the elevation block 152 to facilitate rotation of the lead screw 154.

Bezel assembly 164 is attached to the bezel traveler 156 by fastener 166. A variety of different bezel assemblies can be attached to the bezel traveler 156 in accordance to embodiments of the present invention. The illustrated bezel assembly 164 includes opening that extends to bezel opening 170 of bezel 172. A battery powered light assembly 176 can optionally be attached to the opening. The light is transmitted through the opening 168 into the bezel opening 170 to illuminate the sight points 174 or targeting reticule.

Figure 2:
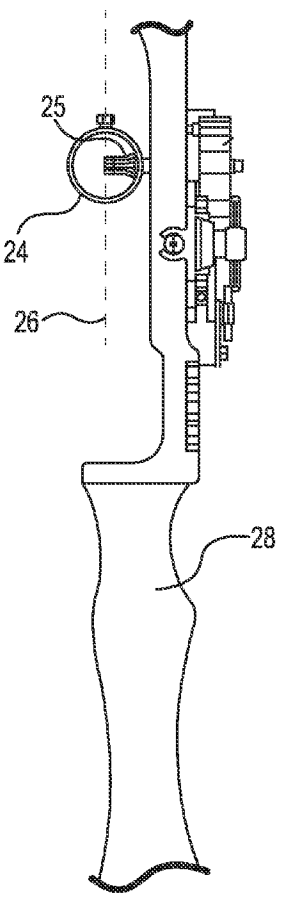
Fig. 2 PRIOR ART
FIG. 2 is a rear view of the bow of FIG. 1 held in a vertical configuration.
Figure 11B:
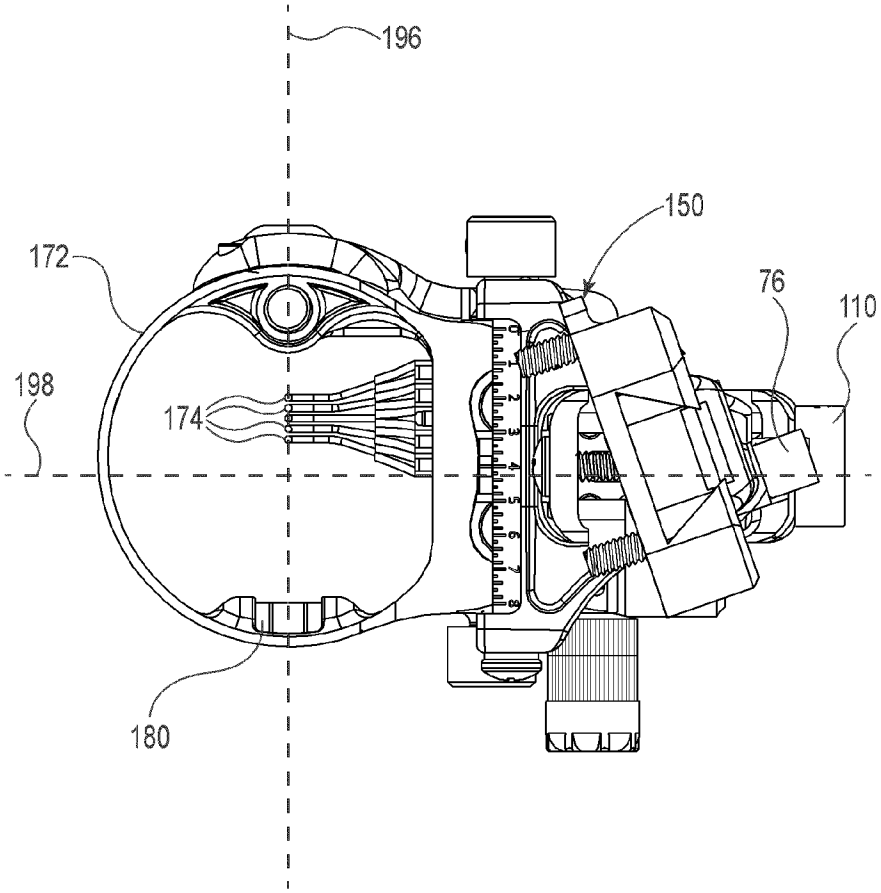
FIG. 11B is a rear view of the bow sight of FIG. 5 with the support assembly rotated to compensate for the bow cant of FIG. 11A.
Figure 11A:
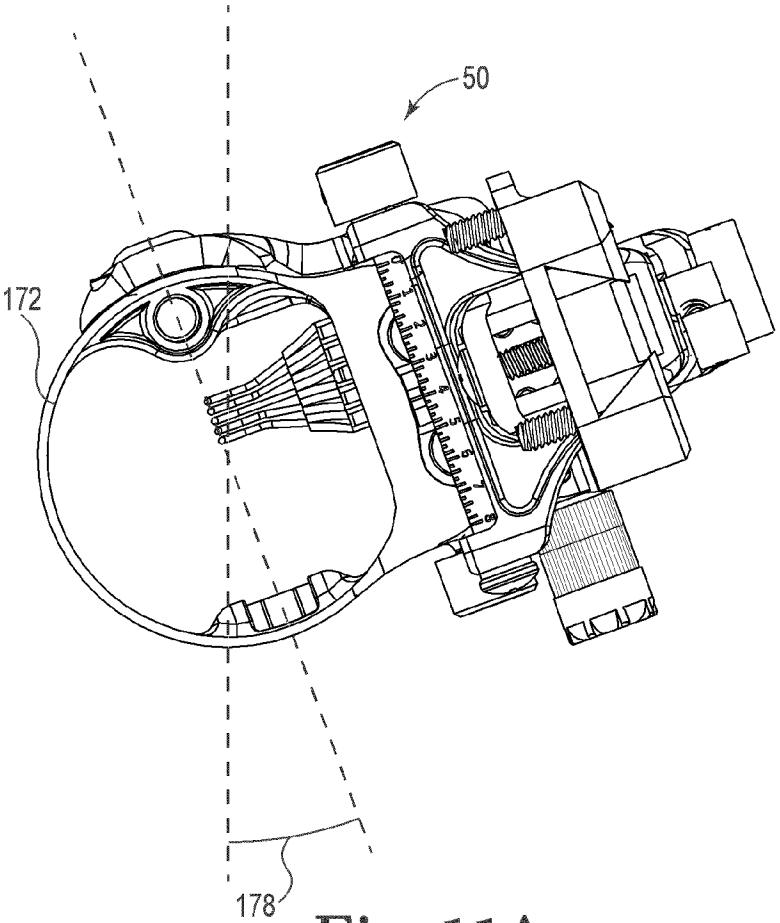
FIG. 11A is rear views of the bow sight of FIG. 5 held at a shooter's bow cant by a right-handed shooter.

FIG. 11A illustrates operation of the bow sight 50 with the bow removed for clarity. The shooter holds the bow in a natural or preferred bow canted, as discussed above in connection with FIG. 2. FIG. 11A illustrates the bow sight 50 canted to the left for a right-handed shooter by an amount corresponding to the shooter bow cant 178. The typical bow cant 178 is on the order of about 10 degrees to about 20 degrees.

Set screw 200 (see FIG. 9) on the proximal portion 56 is loosened to permit the knob 76 to be turned. As the shooter rotates the knob 76, the micro-adjust 64 precisely rotates the intermediate portion 58 relative to the proximal portion 56 until the bezel 172 is level, as illustrated in FIG. 11B. The level 180 aids in the adjustment.

Since this adjustment is specific to the particular shooter, once the adjustment is completed the set screw 200 is tightened to secure the micro-adjust 64. Because the interface between the proximal portion 56 and intermediate portion 58 is located closest to the bow, the windage assembly 118 and elevation assembly 150 both rotate around the Y-axis 54 in direction 190 with the bezel 172. As a result, subsequent adjustment of the elevation assembly 150 causes the bezel 172 and sight pin 174 to travel along a vertical axis 196. Similarly, an adjustment of the windage assembly 118 causes the bezel 172 to travel along a horizontal axis 198.

Figure 12C:
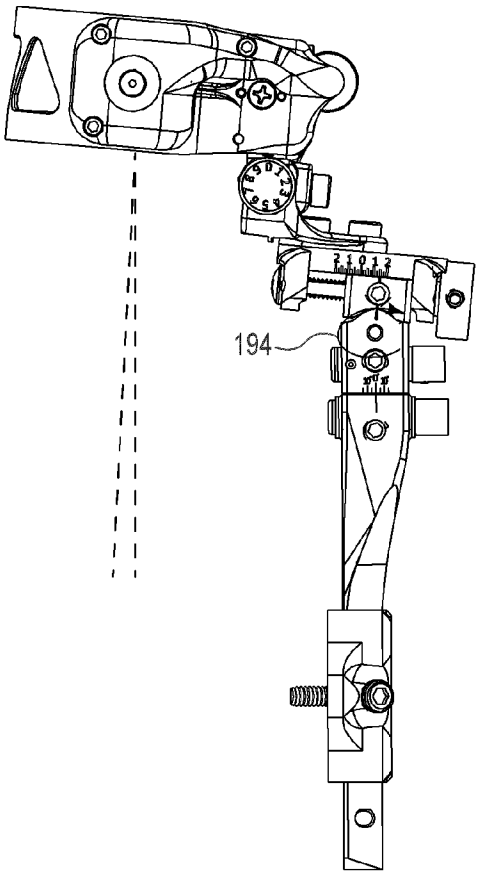
FIG. 12C is top views of the bow sight of FIG. 5 with the support assembly rotated so the bezel is rotated clockwise in accordance with an embodiment of the present disclosure.
Figure 12B:
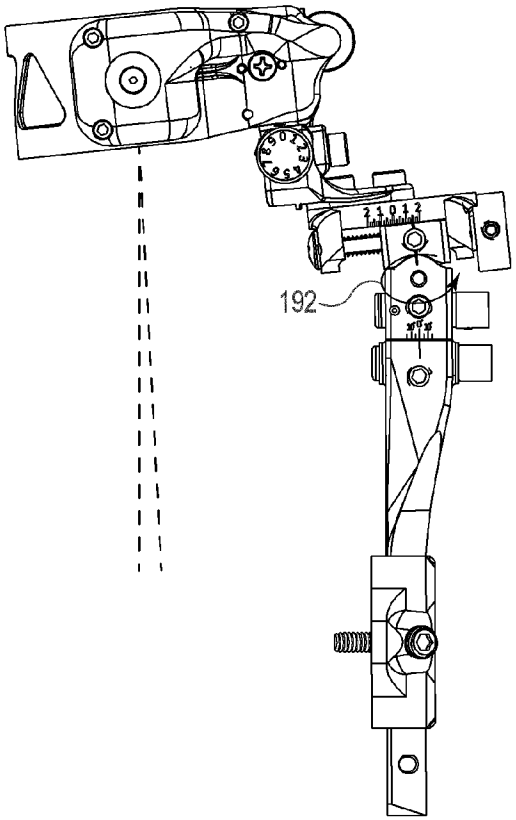
FIG. 12B is top views of the bow sight of FIG. 5 with the support assembly rotated so the bezel is rotated counterclockwise in accordance with an embodiment of the present disclosure.
Figure 12A:
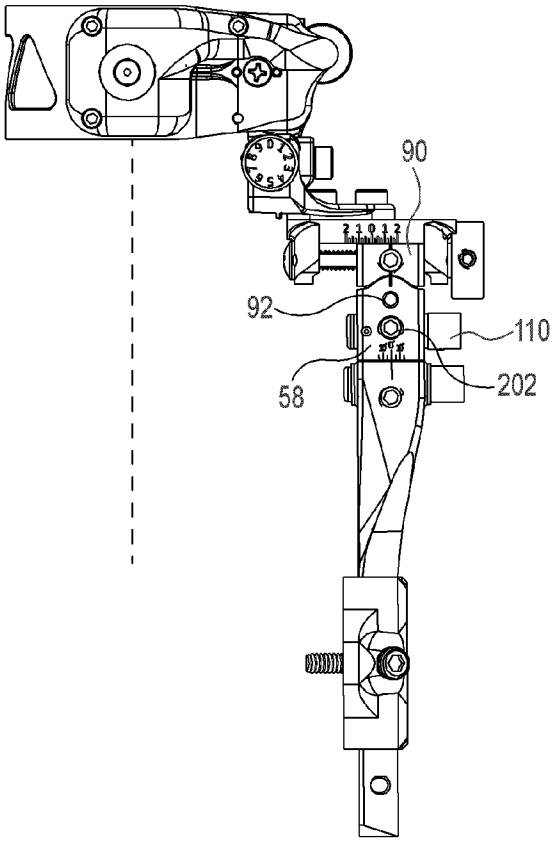
FIG. 12A is top views of the bow sight of FIG. 5 with the bezel in a neutral position in accordance with an embodiment of the present disclosure.

FIGS. 12A-12C illustrate front and back adjustment of the bezel 172 around the Z-axis 96. Set screw 202 (see FIG. 9) is loosened and the knob 110 is turned to activate micro-adjust 100. The distal portion 90 rotates around pivot pin 92 relative to the intermediate portion 58. Depending on the direction of rotation of the knob 110, the bezel 172 may rotate counterclockwise (toward the shooter) as illustrated in FIG. 12B or clockwise 192 (away from the shooter) as illustrated in FIG. 12C. Once the adjustment is completed the set screw 202 is tightened.

Figure 13:
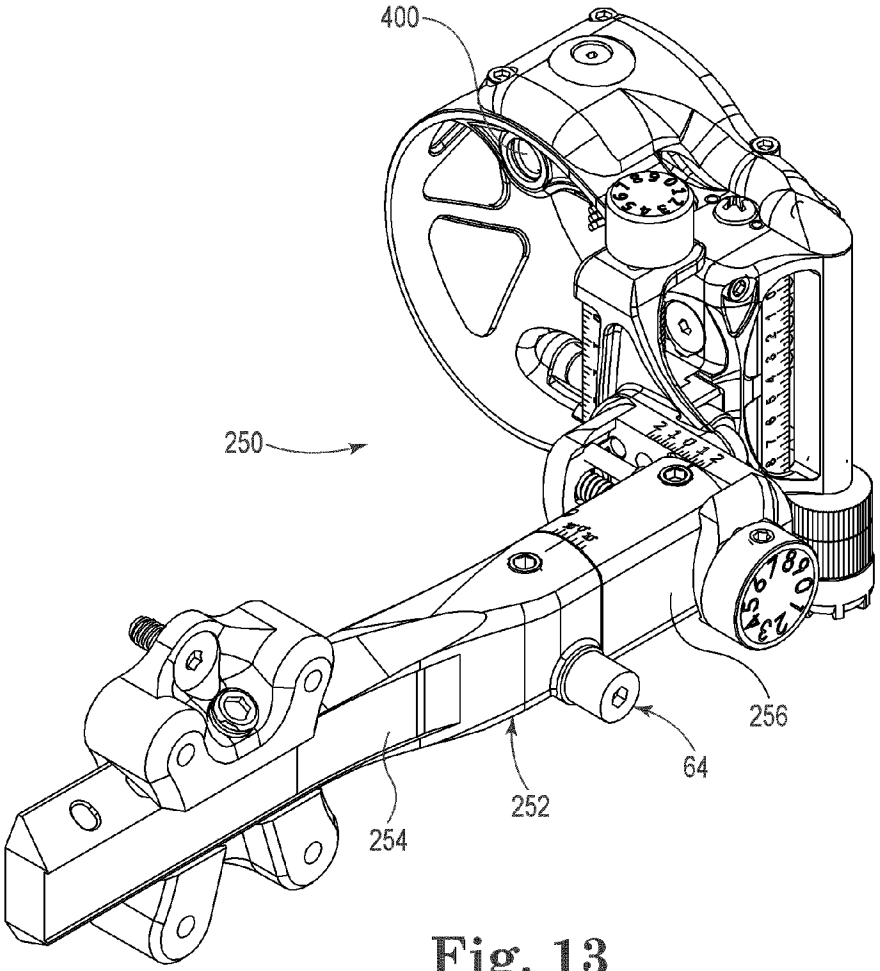
FIG. 13 illustrates an alternate bow sight in accordance with an embodiment of the present disclosure.

FIG. 13 illustrates an alternate multi-axis bow sight 250 with a two-piece segmented support assembly 252 in accordance with an embodiment of the present disclosure. The segmented support assembly 252 includes a proximal portion 254 that attaches to a bow and a distal portion 256. The distal portion 256 is pivotally attached to the proximal portion 254 using pivot pin 62 (see FIG. 6). The rotational position of the distal portion 256 relative to the proximal portion 254 is controlled using micro-adjust 64 (see FIG. 7). The embodiment of FIG. 13 combines the intermediate portion 58 with the distal portion 90 as a single component 256, eliminating the need for the micro-adjust 100. The bow sight 250 is otherwise substantially the same as the bow sight 50 discussed above.

Figure 14:
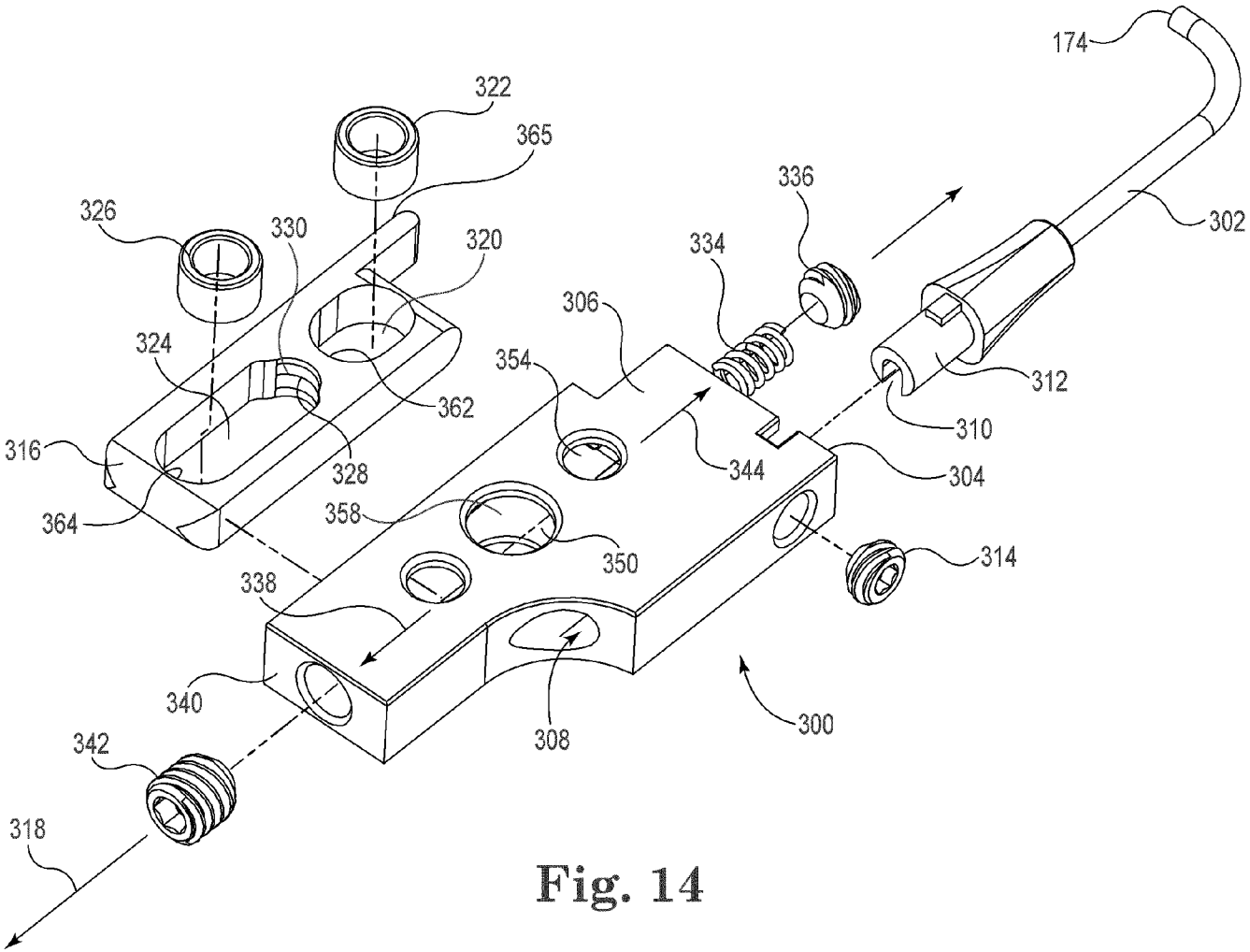
FIG. 14 is an exploded view of a sight pin in accordance with an embodiment of the present disclosure.

FIG. 14 is an exploded view of a sight pin assembly 300 suitable for use in a bow sight in accordance with an embodiment of the present disclosure. Sight pin 302 includes a sight point 174 at a distal and a base 312 at the proximal end that attaches to distal end 304 of carrier 306. Opening 308 is located in the carrier 306 to receive optical fiber (not shown) that couples with recess 310 in the base 312 of the sight pin 302. Set screw 314 secures the sight pin 302 to the carrier 306.

Slider 316 is configured to move inside carrier 306 along axis 318. The slider 316 includes first opening 320 with washer 322 and second opening 324 with washer 326. Distal edge 328 of the second opening 324 includes threads 330 configured to couple with lead screw 332 on the bezel 172 (see FIG. 15B). Spring 334 is retained in the carrier 306 by set screw 336. The spring 334 biases the slider 316 in direction 338 toward proximal edge 340 of the carrier 306 and threads 330 into engagement with the micro-adjust 332 in an unlocked position. In the unlocked position, rotation of the micro-adjust 332 displaces the sight pin assembly 300 within the bezel opening 170 along the axis 368.

Pin adjustment screw 342 is provided at the proximal edge 340 of the carrier 306 to shift the slider 316 in the opposite direction 344 to disengage the threads 330 on the slider 316 from the lead screw 332. When fully advanced, the pin adjustment screws 342 presses proximal edges 362, 364 of the openings 320, 324 in the slider 316 against the washers 322, 326 and the stabilizing pins 352, 356, respectively, securing the pin 300 in the locked position relative to the bezel opening 170. In the locked position, indicator tab 365 extends into the bezel opening 170 to provide an indication of the locked position. Since each sight pin assembly 300 includes a separate pin adjustment screw 342, the sight pin assembly 300 can be independently and selectively adjusted within the bezel opening 170.

Figure 15C:
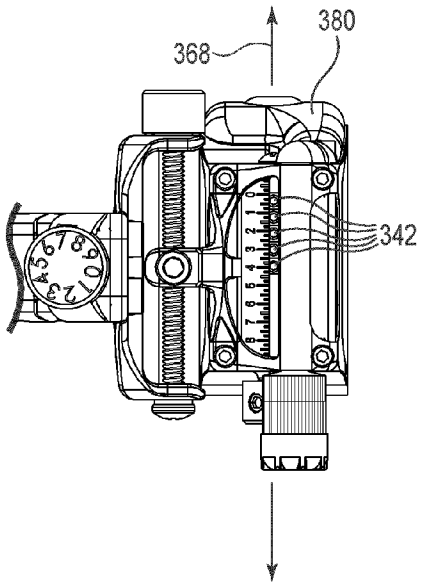
FIG. 15C is a side view of the bezel of FIG. 5 showing the pin adjustment screws for the pin array adjustment system of the present disclosure.
Figure 15A:
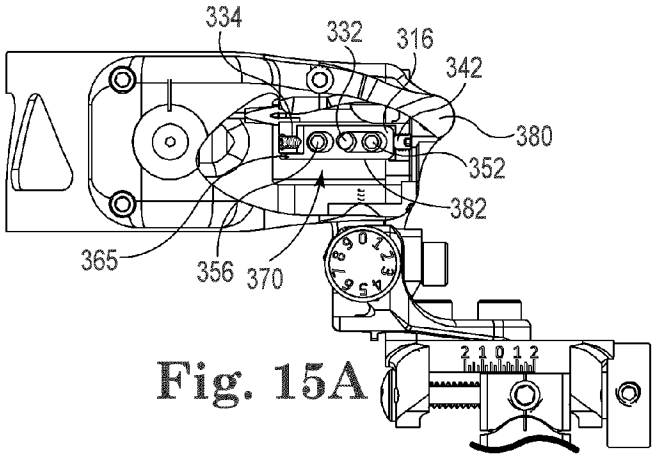
FIG. 15A is a top cut-away view of the bezel of FIG. 5 showing the pin array adjustment system of the present disclosure.
Figure 15B:
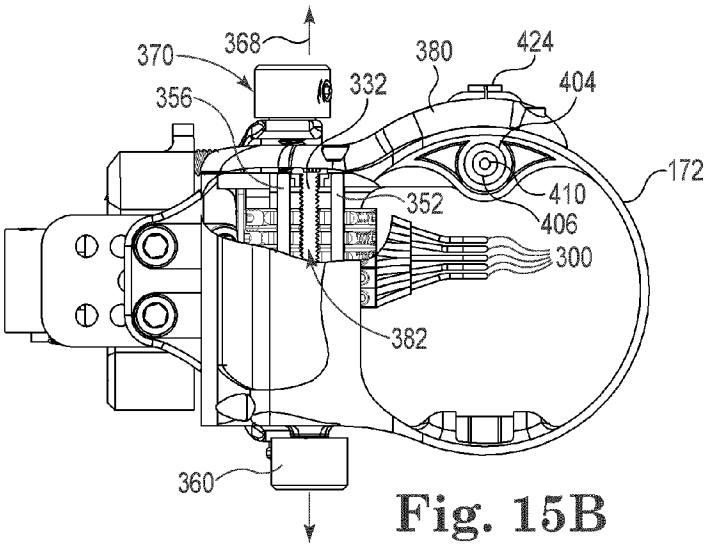
FIG. 15B is a front cut-away view of the bezel of FIG. 5 showing the pin array adjustment system of the present disclosure.

As best illustrated in FIGS. 15A and 15B, lead screw 332 of micro-adjust 382 extends though opening 350 in the carrier 306 and second opening 326 in the slider 316. Stabilizing pin 352 extends though opening 354 in the carrier 306 and through the washer 322 located in first opening 320 of the slider 316. Stabilizing pin 356 extends though opening 358 in the carrier 306 and through the washer 326 located in second opening 324 of the slider 316. In the illustrated embodiment, the sight points 174 of the sight pins 302 are generally oriented along vertical axis 196 (see e.g., FIG. 11B), which is also parallel to the lead screw 332 and the stabilizing pins 352, 356.

Fiber optics extending from the openings 308 in the housings 306 exit the side of the bezel 172 and are retained under covering 380. The covering 380 permits light to pass through to illuminate the fiber optics.

In operation, knob 360 is used to rotate the lead screw 332 of the micro-adjust 382, which raises and lowers the pins 300 along axis 368 that is parallel to the Z-axis 96. Once a particular pin 300 is in the desired location, the shooter advances the pin adjustment screws 342 (see also FIG. 15C) into the carrier 306 to disengage the slider 316 from the lead screw 332. The pin adjustment screws 342 presses proximal edges 362, 364 against the washers 322, 326 and the stabilizing pins 352, 356, respectively, to lock the pin 300 in place.

The present pin array adjustment system 370 permits the single micro-adjust 382 to selectively and independently position each of the plurality of sight pins 300. If one of the sight pins 300 contacts an adjacent sight pin 300 that is already secured in the desired location, further rotation of the lead screw 332 will overcome the spring force 366 and permits the slider 316 to be displaced in the direction 344, thereby preventing damage to the threads 330 on the slider 316 or the lead screw 332.

The present bow sight preferably includes an eye alignment assembly 400 that provides an indication of orientation of a shooter's eye in the pitch and yaw directions relative to the bow. The eye alignment assembly 400 assists the shooter to consistently position her body in the correct orientation relative to the bow, so that over time the bow becomes an extension of the user's body. The eye alignment assembly decouples the user's line of sight from the operating axis/plane of the bow. Suitable eye alignment assemblies are disclosed in U.S. Pat. No. 7,814,668 (Pulkrabek et al); U.S. Pat. No. 7,921,570 (Pulkrabek et al.); U.S. Pat. No. 8,079,153 (Pulkrabek et al.); and U.S. Patent Publication 2011/0167654 (Pulkrabek), the entire disclosures of which are hereby incorporated by reference.

Figure 16:
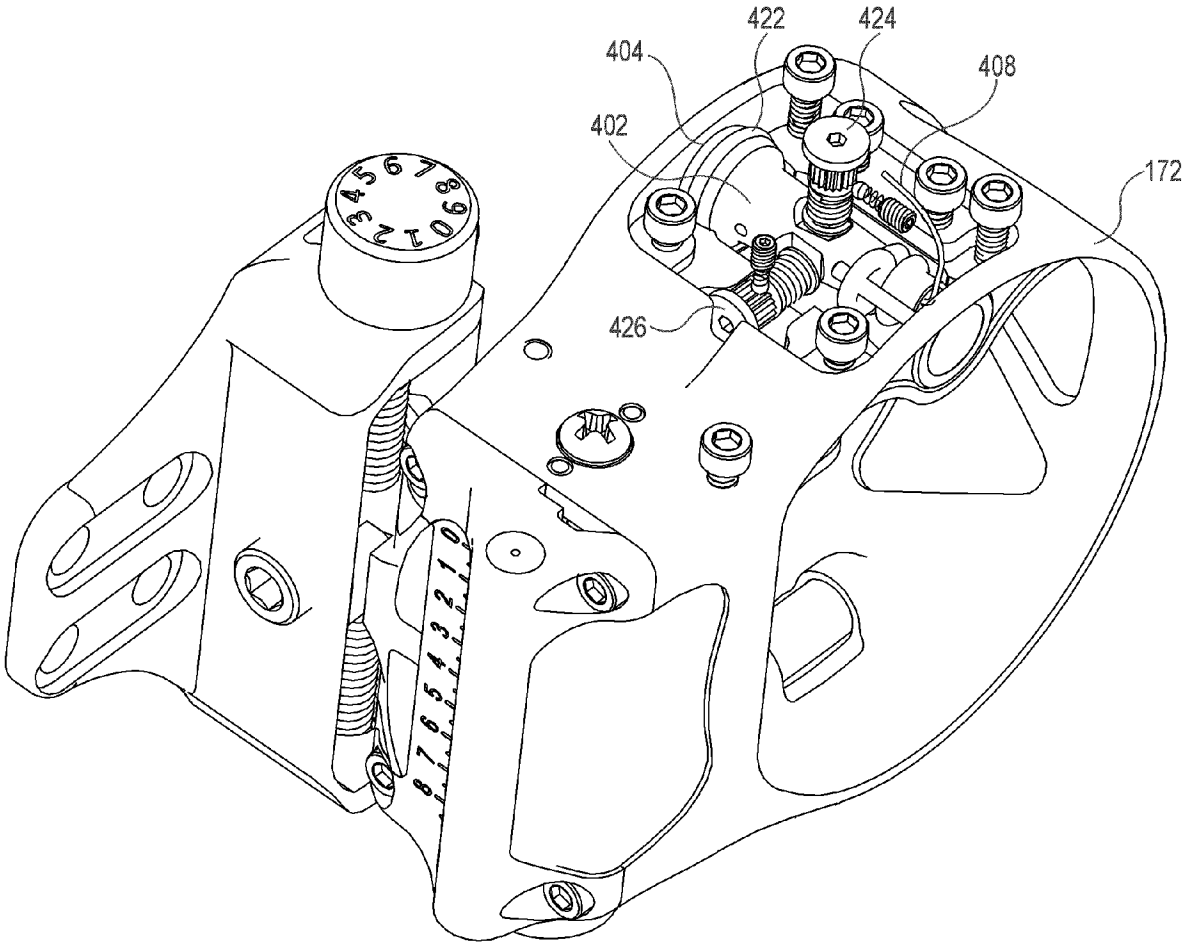
FIG. 16 is a top view of the bezel of FIG. 5 with the cover removed to reveal the eye alignment assembly of the present disclosure.
Figure 17:
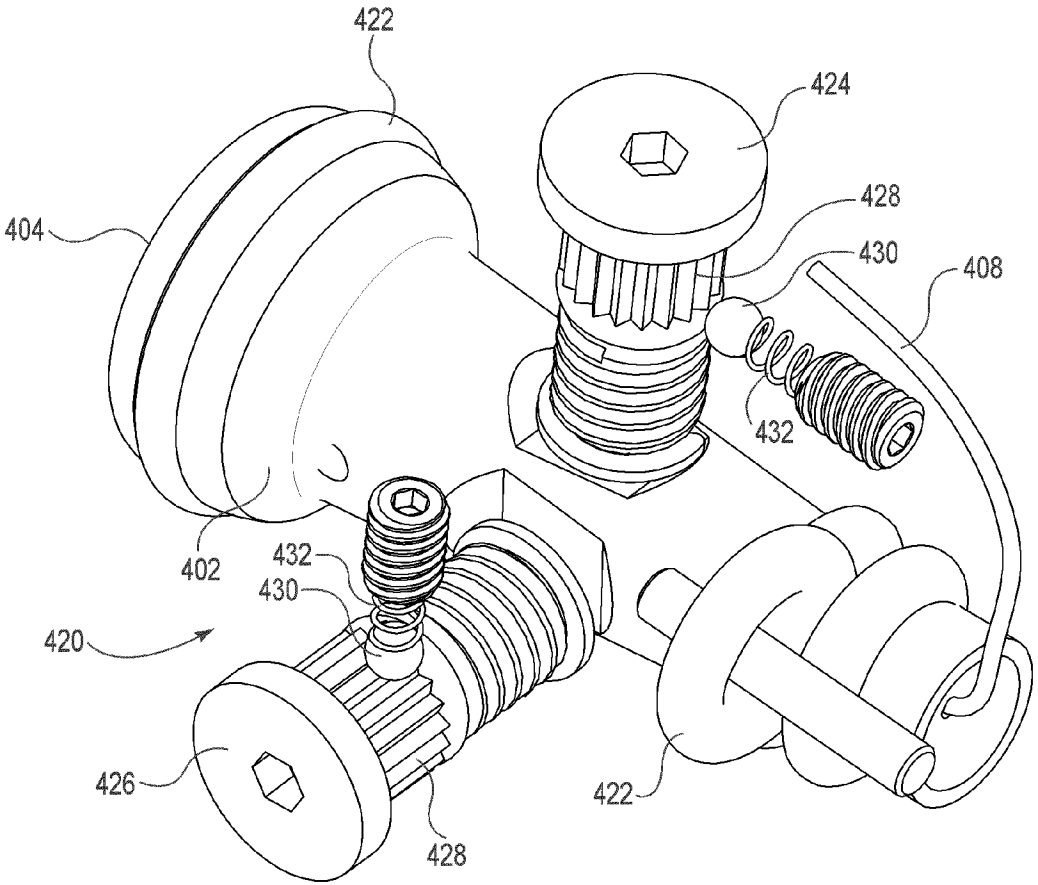
FIG. 17 is a perspective view of the eye alignment assembly of FIG. 16.

FIGS. 16 and 17 illustrates an eye alignment assembly 400 including tubular structure 402 mounted in the bezel 172. Lens 404 is fixedly mounted to, or integrally formed into, front end of the tubular structure 402. Fiber optic 408 is attached to rear end of the tubular structure 404.

As best illustrated in FIG. 15B, alignment indicia 406 is located on the lens 404. The distal end of the fiber optic 408 acts as sight point 410. The sight point 410 is located a fixed distance behind alignment indicia 406 on the lens 404. The alignment indicia 406 can be a point, a circle, cross-hairs, or a variety of other configurations. The term "sight point" is used herein to generically refer to a portion of an optical fiber. The sight point can be one or more ends of the optical fiber or a side edge.

In use, when alignment indicia 406 on lens 404 is aligned with sight point 410 on optical fiber 408, the shooter's eye is in a predetermined relationship with respect to the eye alignment assembly 400, and hence, the present bow sight 50. That is, alignment indicia 406 and sight point 410 can only be viewed in a predetermined way from a predetermined approximate angle, assuring that the shooter's shooting eye is consistently positioned relative to the present sight 50.

The eye alignment assembly 400 includes adjustment mechanisms 420 for pitch (rotation in a plane perpendicular to the Y-axis 130) and yaw (rotation in a plane perpendicular to the Z-axis 96). The adjustment mechanism 420 permits the eye alignment assembly 400 to be easily adjusted for the shooting style of a particular shooter.

In the illustrated embodiment, the tubular structure 402 includes at least one elastomeric O-ring 422 that engage with the bezel 172. Adjustment screw 424 attached to cover 380 displaces the tubular structure 402 up and down (pitch) in a plane perpendicular to the Y-axis 130 by compressing the O-rings 422. Adjustment screw 426 attached to the bezel 172 displaces the tubular structure 402 left and right (yaw) in a plane perpendicular to the Z-axis 96 by compressing the O-rings 422. The adjustment screws 424, 426 preferably include tooth portions 428. Bearings 430 are preferably biased by springs 432 into engagement with the tooth portions 428 to provide feedback during rotation of the adjustment screws 424, 426 and to prevent inadvertent adjustments.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A sighting device for a bow, the sighting device comprising:

a support assembly adapted to attach to the bow;

a bezel assembly attached to the support assembly, the bezel assembly comprising a micro-adjust with a lead screw located adjacent to a bezel opening;

a plurality of pin carriers each comprising a slider selectively moveable between an engaged position coupled to the lead screw and a disengaged position, such that each pin carrier is adapted to be selectively and independently displaced or not displaced by rotation of the lead screw; and a plurality of sight pins each with a sight point at a distal end located in the bezel opening and a proximal end coupled to one of the pin carriers, the sight points generally oriented along an axis that is parallel to the lead screw, the sight points are adapted to align the bow with a target viewed through the bezel opening.

2. The sighting device of claim 1 wherein the pin carriers include a spring that biases the slider into the engaged position.

3. The sighting device of claim 1 wherein the pin carriers include a pin adjustment screw adapted to retain the slider in the disengaged position.

4. The sighting device of claim 1 comprising:

at least one stabilizing pin parallel to the lead screw and extending through each of the pin carriers; and at least one pin adjustment screw on the pin carriers adapted to displace the slider from an unlocked position to a locked position engaged with the stabilizing pin to retain the pin carrier in a particular location relative to the bezel opening.

5. The sighting device of claim 4 wherein the slider includes an indicator tab visible in the bezel opening providing an indication of the locked position and the unlocked position.

6. The sighting device of claim 1 wherein the support assembly comprises:

a proximal portion that is adapted to attach to the bow, the proximal portion comprising a longitudinal axis; and a distal portion rotatably attached to the proximal portion and adapted to rotate around the longitudinal axis relative to the proximal portion so the sight points are oriented generally along a vertical axis while the bow is held at a bow cant greater than zero.

7. The sighting device of claim 6 comprising:

a micro-adjust adapted to control the rotational position around the longitudinal axis of the distal portion relative to the proximal portion; and an elevation assembly attaching the distal portion to the bezel assembly, the elevation assembly adapted to move the bezel assembly along a substantially vertical axis while the bow is held at a bow cant greater than zero, wherein the micro-adjust decouples the shooter's bow cant from operation of the elevation assembly.

8. The sighting device of claim 1 comprising an adjustable windage assembly interposed between the distal portion and the bezel assembly.

9. The sighting device of claim 1 comprising:

an eye alignment assembly mounted to the bezel assembly, the eye alignment assembly comprising a sight point of an optical fiber positioned a distance behind an alignment indicia on a lens; and an adjustment system adapted to reorient the lens relative to the bezel assembly, the eye alignment assembly providing an indication of orientation of the shooter relative to the bow in at least two degrees of freedom.

10. The sighting device of claim 9 wherein the alignment indicia on the lens is aligned with the sight point on the optical fiber only when the shooter is in a predetermined relationship with respect to the sight.

11. A method of adjusting sight pins on a bow sight for a bow, the method comprising the steps of:

selectively moving a slider on each of a plurality of pin carriers to either an engaged position coupled to a lead screw of a micro-adjust located in a bezel assembly, or a disengaged position not engaged with the lead screw, such that each pin carrier is selectively and independently displaced or not displaced by rotation of the micro-adjust; and rotating the micro-adjust to displace only the pin carriers with its sliders in the engaged position, while simultaneously not displacing the pin carriers with the sliders to the disengaged position.

12. The method of claim 11 comprising the steps of:

attaching at least one sight pin to each pin carrier so that sight points on the sight pins are located in the bezel opening; and orienting the sight points generally along an axis that is parallel to the lead screw.

13. The method of claim 11 comprising the step of biasing the sliders into the engaged position.

14. The method of claim 11 comprising adjusting a pin adjustment screw to retain the sliders to the disengaged position.

15. The method of claim 11 wherein at least one stabilizing pin extends through each of the pin carriers, the method comprising the step of adjusting at least one pin adjustment screw on the pin carriers to bias the slider against the stabilizing pin to a locked position that locks the pin carrier in a particular location relative to a bezel opening.

16. The method of claim 15 comprising providing an indication of the locked position visible in the bezel opening.

17. The method of claim 16 comprising the steps of:

securing one pin carrier relative to the bezel;

rotating the micro-adjust to advance an adjacent pin carrier into contact with the secured pin carrier, wherein continued rotation of the micro-adjust causes the slider of the adjacent pin carrier to disengage from the lead screw.

18. The method of claim 11:

holding the bow at the shooter's bow cant;

operating a micro-adjust to rotate a distal portion of the segmented support assembly around the Y-axis relative to the proximal portion until the bezel assembly is substantially horizontal; and operating an elevation micro-adjust on an elevation assembly attached to the distal portion to move the bezel assembly along a substantially vertical axis while the bow is held at a bow cant greater than zero, wherein the micro-adjust decouples the shooter's bow cant from operation of the elevation assembly.

19. The method of claim 18 comprising adjusting a windage assembly interposed between the distal portion and the bezel assembly to move the bezel assembly substantially horizontally.

20. The method of claim 11 comprising the step of:

holding the bow in a preferred orientation;

viewing an eye alignment assembly mounted on the bezel, the eye alignment assembly including a sight point of an optical fiber and an alignment indicia on a lens; and adjusting the orientation of the eye alignment assembly relative to the bezel assembly so the sight point is aligned with the alignment indicia on a lens.

21. The method of claim 20 comprising the steps of holding the bow so the sight point on the eye alignment assembly is aligned with the alignment indicia on a lens whereby the bow is in the preferred orientation.

* * * * *